US009004317B2

(12) United States Patent
Pozzi

(10) Patent No.: US 9,004,317 B2
(45) Date of Patent: Apr. 14, 2015

(54) PRODUCT PACKAGING AND DISPENSING DEVICE COMPRISING A STERILE FILTER BOTTLE WHICH IS EQUIPPED WITH A NOZZLE

(71) Applicant: Jacques Pozzi, Jouy (FR)

(72) Inventor: Jacques Pozzi, Jouy (FR)

(73) Assignee: Sivel, Lyons (FR)

( * ) Notice: Subject to any disclaimer, the term of this patent is extended or adjusted under 35 U.S.C. 154(b) by 57 days.

(21) Appl. No.: 14/185,139

(22) Filed: Feb. 20, 2014

(65) Prior Publication Data

US 2014/0197207 A1 Jul. 17, 2014

Related U.S. Application Data

(63) Continuation-in-part of application No. 11/572,378, filed as application No. PCT/FR2005/001735 on Jul. 6, 2005, now abandoned.

(30) Foreign Application Priority Data

Jul. 20, 2004 (FR) ..... 04 08031

(51) Int. Cl.
*B05B 11/04* (2006.01)
*B65D 35/38* (2006.01)
*B05B 11/00* (2006.01)

(52) U.S. Cl.
CPC ..... *B65D 35/38* (2013.01); *B05B 11/0021* (2013.01); *B05B 11/3033* (2013.01); *B05B 11/3032* (2013.01); *B05B 11/3029* (2013.01)

(58) Field of Classification Search
CPC ..... B05B 11/3028; B05B 11/3029; B05B 11/3032; B05B 11/3033; B05B 11/0021
USPC ..... 222/189.06, 189.09, 206, 207, 420, 222/212, 214; 604/295, 296
See application file for complete search history.

(56) References Cited

U.S. PATENT DOCUMENTS

| | | | | |
|---|---|---|---|---|
| 2,715,236 | A * | 8/1955 | Tereno | 401/151 |
| 3,300,099 | A * | 1/1967 | Marona | 222/207 |
| 3,451,597 | A * | 6/1969 | Watson, Jr. | 222/207 |
| 3,995,774 | A * | 12/1976 | Cooprider et al. | 222/207 |
| 5,738,067 | A * | 4/1998 | Landwehr et al. | 132/320 |
| 5,862,955 | A * | 1/1999 | Albini et al. | 222/212 |
| 5,971,224 | A * | 10/1999 | Garibaldi | 222/207 |
| 6,354,469 | B1 * | 3/2002 | Pozzi | 222/189.09 |
| 7,878,374 | B2 * | 2/2011 | Decottignies et al. | 222/207 |
| 7,997,453 | B1 * | 8/2011 | Gallegos | 222/207 |
| 2005/0035157 | A1 * | 2/2005 | Brennan et al. | 222/559 |
| 2009/0318883 | A1 * | 12/2009 | Sugahara et al. | 604/298 |
| 2011/0163114 | A1 * | 7/2011 | Webb | 222/1 |
| 2011/0278323 | A1 * | 11/2011 | Pozzi et al. | 222/108 |

* cited by examiner

*Primary Examiner* — Daniel R Shearer
(74) *Attorney, Agent, or Firm* — Miller, Matthias & Hull LLP

(57) ABSTRACT

A device for packaging and dispensing a flowable product comprises a casing comprising a nozzle for dispensing the product and a container designed to contain the product to be packaged. The casing comprises a rigid bottom, an air renewal and filtration assembly, a filter element, and an air inlet passage located in said rigid bottom. The nozzle comprises a tapered portion that defines a free end of the nozzle, an actuating portion resiliently movable between an engagement position and a rest position. A dose-defining chamber may be isolated from the air contained in the container and may have a determined volume in the rest position. The engagement position may be obtained by engaging the actuating portion against a stationary wall portion, so as to empty the chamber and expel a dose exactly corresponding to the determined volume of the chamber.

21 Claims, 8 Drawing Sheets

FIG. 3
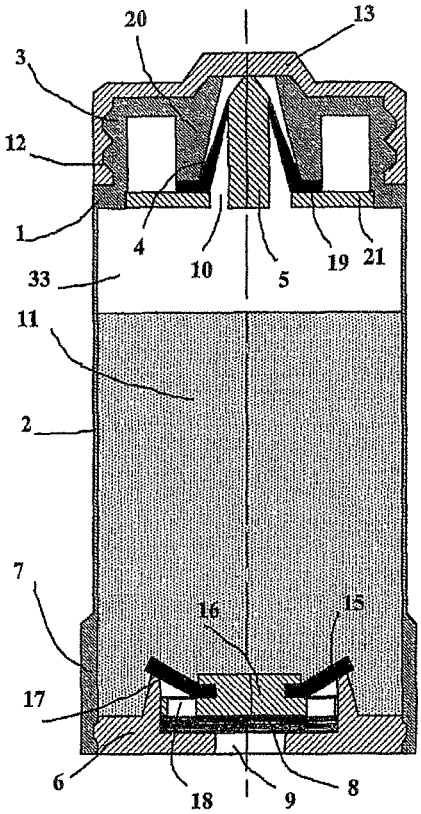
FIG. 4
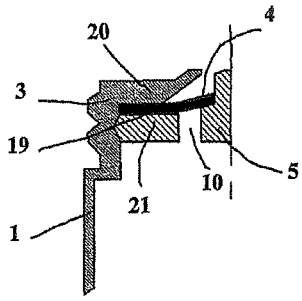
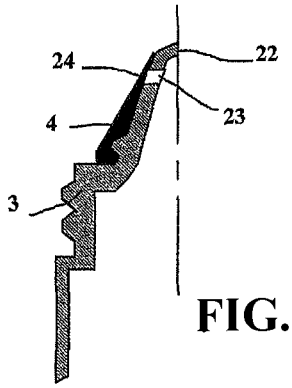
FIG. 5
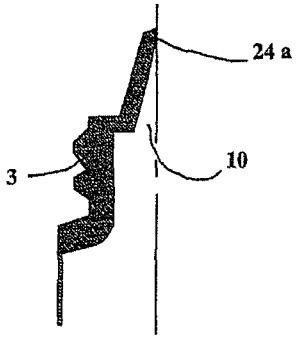
FIG. 5a
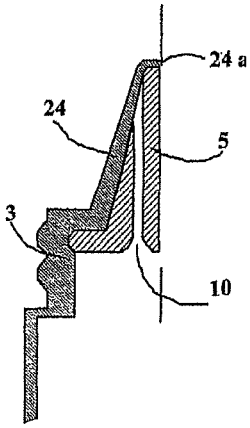
FIG. 5b

PRODUCT PACKAGING AND DISPENSING DEVICE COMPRISING A STERILE FILTER BOTTLE WHICH IS EQUIPPED WITH A NOZZLE

CROSS-REFERENCE TO RELATED APPLICATIONS

This patent application is a continuation-in-part of U.S. application Ser. No. 11/572,378, filed on Jan. 19, 2007, which is a U.S. National Stage Application of PCT/FR05/001735, filed on Jul. 6, 2005, which claims priority to FR 04 08031, filed on Jul. 20, 2004, entitled "Product Packaging and Dispensing Device Comprising a Sterile Filter Bottle Which is Equipped With a Nozzle".

TECHNICAL FIELD

The present invention relates to the technical field of packaging, and more especially to the packaging and dispensing of a product that is either liquid, semi-fluid or in suspension and designed to be preserved under sterile conditions, without the addition of preservatives, and dispensed in portions or doses, notably in drop form.

BACKGROUND

The invention relates more particularly to a device for packaging and dispensing a product comprising a container designed to contain the product that is to be dispensed, with the aid of a nozzle that has no air inlet and with which the container is fitted, the nozzle optionally being an integral part of said container or being mounted in a sealed manner on an open neck of said container.

There are in the prior art packaging devices of conventional structure that can be used to preserve and dispense a product in the form of doses or drops or in any other form, while maintaining its sterility for the entire duration of its use.

These devices are used particularly in pharmaceutical, cosmetic and food applications, and in some cases more particularly in opthalmological applications.

For example, the prior art includes such devices disclosed in patents FR 2 770 495, FR 2 638 428 and FR 2 661 401 in which a container is fitted with a dispensing nozzle that includes a bacteriological filter membrane which sterilizes the product when it is expelled from the container.

In these devices, the container comprises a flexible portion which, when squeezed by hand, forces the product through the bacteriological membrane, through the nozzle and out of said container.

It should be observed that, when a portion of product is expelled from the container, a partial vacuum is created inside the container and must be compensated for, either by admitting more air equivalent to the volume of product expelled, or by a corresponding reduction in the internal volume of the container, which can be done by causing a corresponding deformation of the container.

Present-day membranes do not allow product (liquid, semi-fluid or in suspension) to flow in one direction, i.e. from the interior of the container to the exterior, and air to flow in the opposite direction, i.e. from the exterior to the interior of the container, the reason being that the internal and external faces of the membrane are "wetted" by the passage of the product and the external face resists the entrance of new air.

In this type of device it is therefore necessary to provide a container whose internal volume is variable and reduces as the product contained inside it is dispensed.

This requirement results in unattractive-looking containers that are difficult to manipulate when not protected by a protective outer jacket, or difficult and expensive to manufacture if such a protective outer jacket is provided.

Another problem with these devices is that there is no way of dispensing highly viscous products as these require excessive pressure to force them through the sterilizing membranes, the pores of which are of extremely small diameter. Nor can they be used to dispense products in suspension where the particles axe stopped by the membrane.

Another kind of device that can be used to achieve a similar result is disclosed in FR 2 772 007. This comprises a rigid container designed to contain the product to be packaged, a hand pump of the type with no air inlet mounted on the container, said pump being intended to dispense the product in single doses, and a sterilizing filter placed in an air renewal passage formed in the base of the container.

The main problem with this kind of device is that the bottle is rigid and that a dispensing pump has to be used to dispense the product. Such a pump discloses in patent FR 2 772 007 contains numerous elements, including a dose-defining chamber and two valves for isolating said chamber and dispensing precise doses of product. This construction is very expensive and considerably increases the cost price of the device, and the cost of such a pump can be practically equivalent to that of the bottle itself. The cost of such a device makes it unsuitable for its use in certain applications such as, for example, opthamology, in which the products are sold cheaply and do not need precise dosing because the products are dispensed in drop form. A pump capable of dispensing drops requires very precise construction, which increases its cost by a corresponding amount.

Another problem with such a device is that the pump used has a push rod incorporating its own nozzle through which the product is dispensed. It is inherent in the construction of the pump that the push rod is movable and the product is dispensed when the push rod is released and returns to its initial position under the action of a return spring. This mobility of the push rod, and therefore of the nozzle through which the product is dispensed, makes this device unsuitable, and possibly even dangerous, for dispensing eye drops.

Another problem with a device comprising a pump is that it is impossible to sterilize it by heating it because the pump contains plastic components, some of which are inherently unable to tolerate the high temperatures indispensable for sterilizing the complete device before it is put to use.

Another difficulty with this kind of device is that the pump usually contains metal parts, such as the spring or the valves where these consist of steel balls, and these are incompatible with certain fragile or aggressive products or products that may produce an electrolytic effect.

SUMMARY

One object of the invention is to make it possible to use simple containers that do not deform permanently under the effect of the partial vacuum created when some of the product is expelled.

Another object of the invention is to make it possible to use a filter for new air entering the container without having to use a pump to dispense the product.

More generally, it is an object of the invention to overcome the problems of similar devices of the prior art and to provide such a device that is better suited than other known devices to the diverse requirements of the field.

To achieve these objects, the invention provides a device for packaging and dispensing a product, said product generally being liquid, semi-fluid or in suspension, comprising a container designed to contain the product to be packaged and dispensed with the aid of an accessory, and an air renewal and filtration assembly for air entering the container after a portion or dose of product has been dispensed, the device being characterized in that the dispensing accessory is a nozzle with which the container is provided, the assembly composed of the container and nozzle having at least one flexible portion which, when pressure is applied to it, is capable of expelling product, and a first valve with which the nozzle is provided to allow the product to pass out from the container when pressure is applied to said flexible portion of the assembled container and nozzle without allowing external air to enter said container when said flexible portion is released, and said air renewal and filtration assembly is provided with a second valve allowing external air to enter said container when said flexible portion of the assembled container and nozzle is released while ensuring that none of the product and little or none of the air contained in the container can escape when pressure is applied to said flexible portion.

The device thus makes it possible to dispense portions or doses of product by simple pressure on at least a flexible portion of the container/nozzle assembly, and to compensate for the partial vacuum thus created in the container by admitting air, preferably sterile, through the renewal and filtration assembly.

The container advantageously consists of two portions moulded separately and joined together hermetically, one of which parts may include the nozzle or may be the nozzle itself, to which the first valve and optionally the air renewal and filtration device are connected, while the other portion may include a rigid portion for housing the air renewal and filtration device if the latter is not located in the nozzle.

In a first embodiment, the nozzle is an integral part of the container, for example is part of the same molding as the container, which comprises at least one flexible portion, and a rigid portion, forming the base of the container, can be fitted and joined hermetically to an essentially rigid portion of the container.

In a second embodiment the container comprises an essentially rigid portion to which the nozzle which comprises at least one flexible portion is added and fixed, and said essentially rigid portion may be an extension of the rigid base of the container.

In both variants, said air renewal and filtration assembly may be situated in the nozzle, or in the rigid base connected to a substantially rigid portion of the container, and this assembly comprises a filter that may be overmoulded, ultrasound-welded, or assembled by any other means. It allows external air through by simple suction into the container in order to compensate for the partial vacuum created by the dispensing of some of the product.

If the air renewal and filtration assembly is located in the nozzle, the container does not necessarily have a rigid portion, and the flexible portion may be a portion of the nozzle or a portion of the container body.

Depending on the nature of the product contained in the container, the filter selected will be either hydrophobic or hydrophilic, but always such as to prevent the escape of the product from the interior of the container to the exterior. If the internal face of the filter which is in contact with the product has been wetted, this face is rendered partially or even entirely impervious to air, which likewise cannot escape from the interior of the container to the exterior, or can do so only with great difficulty.

Careful selection of the type of filter thus makes it possible to produce, using the latter, in an advantageously simple manner, a valve that lets external air into the container, but which, when pressure is applied to the flexible portion of the container or nozzle, prevents all liquid and most of the air from escaping to the exterior.

In a variant, the device includes an additional valve which is connected to said air renewal and filtration assembly, is arranged between the filter and the internal volume of the container, and is designed to prevent the escape of the product and air contained in the container through an air inlet passage of said assembly and to prevent any contact between the product and the filter. Such a valve will be used where it is not possible, because of the nature of this product, to find a filter quality compatible with its valve function allowing air to pass from the exterior to the interior of the container, but preventing the passage of product and air in the opposite direction, from the interior to the exterior of the container, after having been wetted by the product. This valve can also be used in all cases where the nature of the filter would be incompatible with the product contained in the container.

This valve may also not be situated in the immediate vicinity of the air renewal assembly but anywhere inside the container, provided that it performs its main function of preventing the passage of air or liquid from the interior to the exterior of the container when pressure is applied to the flexible portion.

Advantageously, this valve is elastically deformable and cooperates with a seat situated on the base, or on the nozzle, or on a component situated in the nozzle. An elastic valve of this kind is effective in preventing any product or air escaping from the container through the air inlet passage, yet letting external air in by bending elastically towards the interior of the container due to the action of external air being sucked in following the expulsion of a portion of product through the dispensing nozzle.

This dispensing nozzle, which can be moulded either with the container body or separately, comprises a valve which may either be of the same construction as the elastic valve situated in the air renewal and filtration assembly, or of a different construction, or be formed by the nozzle itself, provided that it is always able to perform the same function, namely to allow product to be expelled by a pressure increase occurring when pressure is applied to the deformable flexible portion, and to prevent any air being drawn in by suction when said flexible portion is released.

In a variant, when the nozzle is made of an elastic material, the nozzle itself has extremities in the form of lips that can open and close on a central seat to form a valve. In this case the first valve, connected to the nozzle, is formed by at least a portion of the nozzle itself.

In another variant the second valve, connected to the air renewal and filtration assembly, may be formed by at least one filter belonging to said assembly.

In yet another variant, and where the air renewal and filtration assembly is situated in the nozzle and includes an additional valve, this second valve connected to this assembly for the admission of air and the first valve connected to the nozzle for the expulsion of product may form a single component.

In this way it is possible to make, in a simple manner, a product-dispensing assembly that is advantageously sterile, made up of a deformable chamber bounded by the container itself and/or its nozzle, and two valves, one allowing only expulsion of the product through the nozzle when the container and/or its nozzle is or are compressed and the other allowing only the admission of external air through a passage containing a filter when pressure is no longer applied to the container and/or its nozzle.

In certain uses, for which a relative quantity of the product must be dispensed, it may be useful to limit the deformation of at least one flexible portion of the container and/or nozzle, in order to make the dispensing of a portion reproducible. For this purpose, the nozzle and/or the container itself includes at least one component located on the inside or outside of and adjacent to said flexible portion, the deformation of which will be limited by said component, or alternatively said flexible portion is produced in such a way, e.g. concertina-fashion, that it deforms, in more or less the same way every time.

If the air filtration and renewal assembly is situated in the rigid container base, and the deformable flexible portion is situated in the nozzle and its deformation is limited, it may be advantageous to locate the additional valve in the nozzle between the deformable flexible portion and the rigid container base.

In this way, when pressure is applied to the flexible portion of the nozzle and its deformation is limited, the pressure acting on the liquid contained in the nozzle will not be transmitted to the air contained in the container.

In certain conditions of use where the wetting of the internal face of the filter by the product makes it difficult for new air to pass from the exterior into the interior of the container, and/or, more generally, if the elasticity of the flexible portion which tends to return it to its initial position after a portion of product has been expelled, is unable on its own to create a sufficient vacuum for this new air to enter the container, it may be useful to create an extra suction by adding, on the inside or outside of the flexible portion of the container and/oz nozzle, at least one elastically deformable component to act as a return spring and apply pressure to at least one flexible portion.

In preferred embodiments, the flexible portion is provided with an actuating portion that is resiliently movable between an engagement position and a rest position, the actuating portion being axially shifted with respect to the free end of the nozzle. A dose-defining chamber extends between a stationary wall portion and a displaceable wall portion that is part of the flexible portion. A rigid stopper element is provided to form a part of the stationary wall portion. The dose-defining chamber is isolated from the air contained in the container by a specific valve. The dose-defining chamber has a determined volume in the rest position of the actuating portion. The engagement position is obtained by engaging the actuating portion of the nozzle against the stationary wall portion, so as to empty the chamber and expel a dose exactly corresponding to the determined volume of the chamber.

Preferably, the flexible portion comprises a biasing annular end adjacent to the displaceable wall portion and configured to generate a bias which strives to move the displaceable wall portion apart relative to the stationary wall portion. In one variant, the biasing annular end is hingeably connected to the stationary wall portion and extends inclined inwardly therefrom in the rest position of the actuating portion. In the engagement position of the actuating portion, the biasing annular end extends along and in contact with the stationary wall portion. In another variant, the biasing annular end is hingeably connected to an outer wall portion of the nozzle, distinct from the stationary wall portion.

A rigid outer layer may be used to reinforce the actuating portion, the biasing annular end being only connected to the inner layer of the actuating portion. The outer contact surface to be pushed thus may be a rigid surface. As a result, the product in the chamber may be efficiently compressed and expelled, in a same manner after repeated use of the actuating portion of the nozzle.

Lastly, the container can be filled through the opposite end from the nozzle before the application of a rigid base moulded separately from the rest of the container, and joined hermetically to a substantially rigid portion of the container.

Other features and advantages of the invention will be found in the description given below, with reference to the appended drawings, which show, by way of non-restrictive examples, various embodiments and implementations of the subject of the invention.

BRIEF DESCRIPTION OF THE DRAWINGS

In these drawings:

FIG. 3 is a view in axial cross section of a variant of the device illustrated in FIG. 1, in which an additional valve is situated in the rigid base of the container;

FIG. 4 is an enlarged view in partial axial half-cross section showing a second embodiment of the valve in the nozzle;

FIG. 5 is a view similar to FIG. 4 in which a third embodiment of the valve is shown;

FIGS. 5*a* and 5*b* are views, similar to FIG. 5, of nozzle variants in which the nozzle itself acts as the valve;

In the various figures, identical reference numbers denote similar elements of the various examples of embodiments illustrated and described.

DETAILED DESCRIPTION

Figure 1:
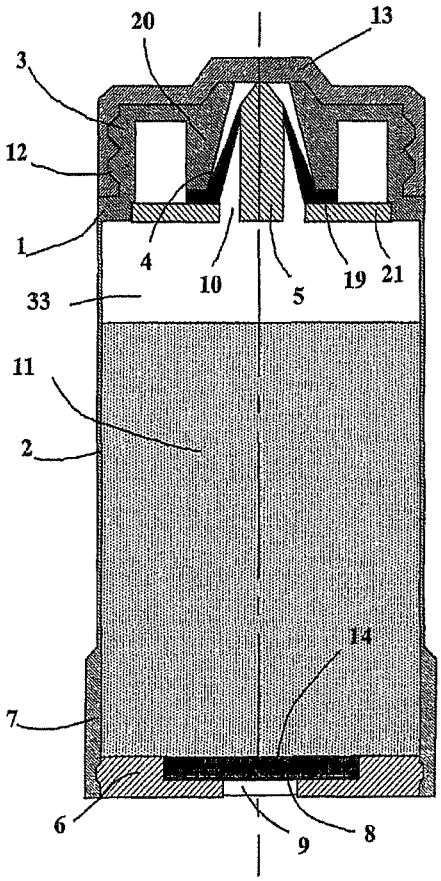
FIG. 1 is a schematic view in axial cross section of a first example of a device in accordance with the invention, showing a container in two parts fitted together hermetically, one part being made up of a flexible body and a nozzle moulded integrally with the body and incorporating a valve, and the other part being a rigid base containing an air renewal and filtration assembly.

In a form shown in FIG. 1, the packaging and dispensing device comprises a container 1 made up of: a generally cylindrically shaped flexible central portion 2; a rigid lower end portion or body 7, also generally cylindrically shaped; attached hermetically to a rigid base 6 incorporating an air renewal and filtration assembly comprising an air inlet passage 9 leading to an air filter 8; and an upper end portion forming a nozzle 3 incorporating an elastic annular valve 4 acting in conjunction with a central axial seat 5 to open or close a channel 10 defined around the seat 5, for the purpose of dispensing the product 11 contained in the body of the container.

The elastic valve has an annular flange 19 trapped between a central annular axial portion 20 of the nozzle 3 and radial annular extension 21 of the seat 5; and a deformable part-cylindrical part-conical portion 4 which rests on the central seat 5 in the rest position. This valve is installed in such a way that at rest it is in compression on the seat 5, so blocking the passage 10, when it is not stressed.

The nozzle portion 3 may have an external thread 12 so that a protective cap 13 can be screwed on.

The filter 8 is attached hermetically to the rigid base 6, by overmoulding, ultrasound welding or any other means so that the air entering the container 1 through the passage 9 has to pass through this filter 8. The internal face 14 of the filter 8 in constant contact with the product contained in the internal volume of the body 11 of the container 1 is wetted by this product, which makes it effectively impossible for air to pass from the interior to the exterior of the container. The nature of the filter 8, which is selected to suit the liquid or semi-fluid product or product in suspension that is to be dispensed, ensures that no product can pass from the interior to the exterior of the container. Thus, if the product to be packaged and dispensed is aqueous, a hydrophobic-type filter will be selected, and if the product is nonaqueous a hydrophilic-type filter will be selected.

In this example, the container with its portions 2, 7 and the nozzle 3 is produced as a single moulding from a synthetic material, as are each of the elements forming the base 6, the cap 13 and the seat 5-21.

Figure 2:
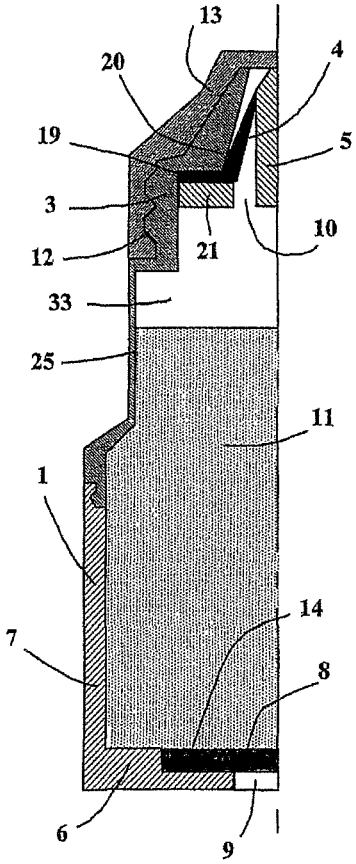
FIG. 2 is a view in axial half-cross section of a variant of the invention, showing a nozzle moulded separately from and fitted to the rest of the container and containing a flexible portion and a valve.

FIG. 2 shows a variant of the device shown in FIG. 1 in which the nozzle 3, equipped with the elastic valve 4 acting on the seat 5-21 as in FIG. 1, is produced, as a moulding of synthetic material, separately from the container 1, which is also moulded from a synthetic material. This container 1 comprises a rigid portion 7 to which the nozzle 3 is hermetically attached. This rigid portion 7 is an extension of the base 6 containing the filter 8 of the air renewal and filtration assembly. The nozzle 3 comprises a flexible portion 25, functionally equivalent to the flexible portion 2 of the container 1 of FIG. 1 and attached to the portion 7 by a more rigid end portion.

FIG. 3 shows a device similar to that shown in FIG. 1 in which there has been added to the air renewal and filtration assembly an additional valve 15 in the rigid base 6, to isolate the filter 8 from the product to be dispensed, if the nature of this product makes it impossible to find a type of filter compatible with its valve function or if the nature of the filter would not allow contact with the product without causing deterioration of one or the other.

This elastic valve 15, which is in the shape of a flat or slightly dished annular disk, is held by a roundel 16, moulded separately and attached to the rigid base 6, or moulded integrally with this base 6, and the valve 15 acts on a seat that is advantageously but not necessarily conical 17 and forms part of the base 6. The fitting of this valve 15 between the roundel 16 and the seat 17 is such that the elastic valve 15 is normally permanently pressed against the seat 17. It allows the opening and closing of an inlet passage 18 formed in the roundel 16 or in the base 6 which the air follows after passing first through the first passage 9 and then through the filter 8.

Figure 6:
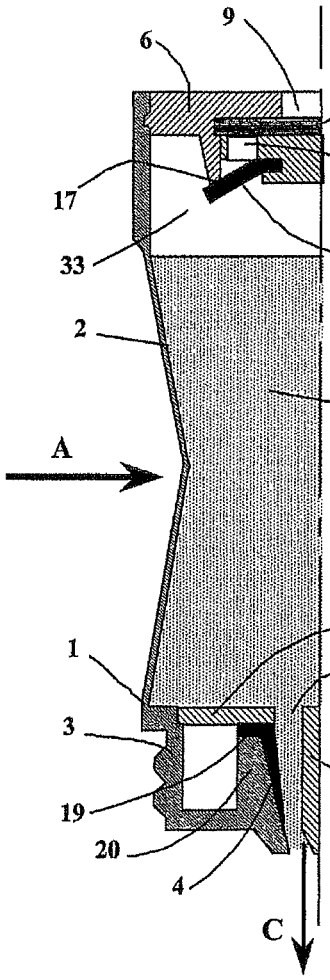
FIG. 6 is a view in axial half-cross section of a device similar to that of FIG. 3, in the position of use when pressure is applied to the flexible portion of the container in order to dispense product.
Figure 7:
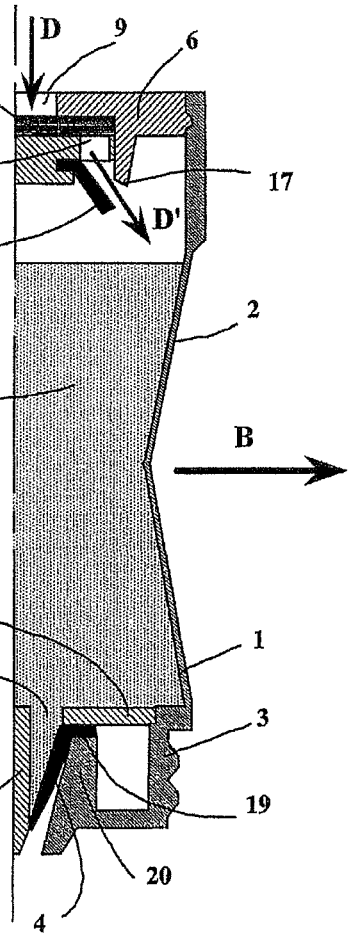
FIG. 7 is a view similar to FIG. 6 when pressure is no longer applied to the flexible portion of the container which springs back to its initial shape.

The device as shown in FIG. 3 works in the following manner, referring to FIGS. 6 and 7 in which the container is shown upside down, that is with the nozzle 3 pointing downwards.

Hand pressure by a user in the direction of arrow A (FIG. 6) on the flexible portion 2 of the container 1 increases the pressure inside the said container 1. This pressure increase both keeps the valve 15 closed so that no product 11 or air 33 can escape through the base 6, and deforms the elastic portion of the valve 4 which lifts off the central part of the seat 5, allowing the product 11 to escape in the direction of arrow C through passageway 10.

In this way a portion, dose or drop of the product is dispensed.

This dispensing of the product ceases when the user removes the pressure on the flexible portion 2 of the container 1.

At this point, the pressure on the interior of the container 1 having been removed, the valve 4 returns elastically to the rest position where it is in contact with the central part of the seat 5 and thus closes the outlet channel 10.

With the total relaxation of pressure on the flexible portion 2 of the container 1, the natural elasticity of this flexible part tends to cause it to return to its initial position in the direction of arrow B (FIG. 7) and creates a pressure drop inside the container 1 which tends to pull in air from the outside in order to make up for the loss of volume of the product, some of which has been expelled in the preceding dispensing phase.

This pressure drop tends to keep the valve 4 closed, which is thus in firm leaktight contact with the seat 5 preventing outside air from getting in through the passage 10 and tends to raise the elastic portion of the valve 15 which lifts off the seat 17 allowing external air to enter the container through the channel 9 in the direction of arrow D, then through the filter 8 and finally through the passage 18 as shown by arrow D'.

This entry of external air stops once the internal pressure of the container 1 and the external pressure have equalized.

At this point the natural elasticity of the valve 15 causes it to return to its initial position where it is in contact with the seat 17. The whole of the device is now in equilibrium, and the product is isolated from the external atmosphere and protected from contamination.

The volume of product that has been dispensed has been replaced by an equivalent volume of filtered air.

The filter 8 may preferably have sterilizing qualities and, if the whole of the device has either been filled in sterile conditions or undergone final sterilization after being filled, the product can be kept sterile for the entire period of its use.

The manner of operation of the device shown in FIG. 1, that is without the additional valve 15, is substantially the same. Here, it is the filter 8 itself which acts as the valve in preventing any product or internal air from getting out during the first phase (arrow A) and allowing external air to get into the container in the second phase (arrow B).

The manner of operation of the device shown in FIG. 2 is also substantially the same. Here, it is the flexible portion 25 of the nozzle 3 that is squeezed rather than the flexible portion 2 of the container 1 of FIGS. 1 and 3.

Another embodiment of the valve 4 situated in the nozzle 3 is illustrated in FIG. 4. This version is a valve 4 of similar construction to the valve 15 situated in the base 6 seen in FIG. 3. The external portion 19 of the valve 4 is held between the inside face 20 of the nozzle 3 and the external portion 21 of the seat 5. Like the valve 15, the valve 4 is always mounted with one face pressed against the seat 5 so that, after lifting to let the product out through the passage 10 due to a pressure increase inside the container 1, it moves back into contact with the seat 5 owing to its natural elasticity when this increase in pressure is removed.

FIG. 5 shows a third embodiment of the valve 4, which in this case is on the outside of the nozzle 3. It too is naturally elastic, conical and fitted in such a way that it is pressed elastically against the portion 22 (also conical) of the nozzle 3. This portion 22 contains a sideways orifice 23, although it could be axial, through which the product contained in the container 1 can be dispensed. When the pressure in the container is increased, the flexible portion 24 of the valve 4 lifts and allows the product to pass out of the container through the orifice 23. When the pressure returns to normal, the natural elasticity of the valve 4 causes the flexible portion 24 to return to its original position and so close the passage 23.

FIG. 5*a* shows a construction of the nozzle 3 such that it forms its own valve by closing on itself, dispensing with the presence of a valve seat which is here no longer necessary. At the free end 24*a*, the ends in the form of lips of the flexible nozzle 3 spread apart when increased pressure is applied to the container 1, and thus allow the product to pass out through the passage 10. They then close on themselves when the pressure returns to normal and obstruct the passage 10 so that air cannot get into the container.

FIG. 5*b* shows another form of construction of the nozzle, similar to that shown in FIG. 5*a*, but in which the flexible portion 24 of the nozzle 3 closes on a valve seat and support 5, through which the outlet passage 10 leads. As in the previous example illustrated in FIG. 5*a*, the ends of the flexible portion 24 can likewise separate and close together again in order to expel any product left on the free end 24*a* of the nozzle 3.

This construction relating to the ends of the nozzle 3 in the form of lips may also be applied to the valve 4 shown in FIG. 5.

Figure 8A:
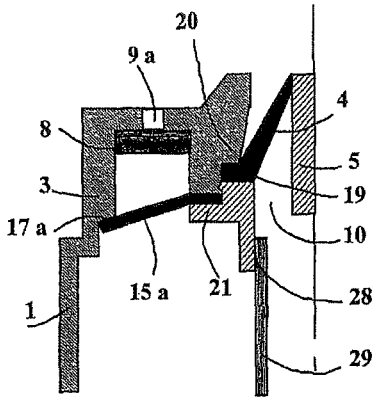
FIG. 8*a* is an enlarged view of the device in partial axial half-cross section showing the air renewal and filtration assembly situated in the nozzle.

FIG. 8*a* shows a variant in which the air renewal and filtration device is located in the nozzle 3. As in FIG. 1, the flange 19 of the valve 4 is gripped between the portions 20 of the nozzle 3 and 21 of the seat 5, and this valve 4 opens when the pressure inside the container 1 is increased, closing again hermetically on the valve seat 5 when the pressure returns to normal. The air inlet passage 9*a* leads through the upper face of the nozzle 3, the filter 8 is positioned on the inside face of this nozzle 3, and the optional valve 15*a*, corresponding functionally to the valve 15 in FIG. 3 and associated with the air renewal device is, if used, gripped between the portion 20 of the nozzle 3 and the portion 21 of the valve seat 5. This valve 15*a* opens and closes elastically in order respectively to allow air in, and to press against the seat 17*a* of the nozzle 3 in the same way as the valve 15 does in FIG. 3.

Figure 8C:
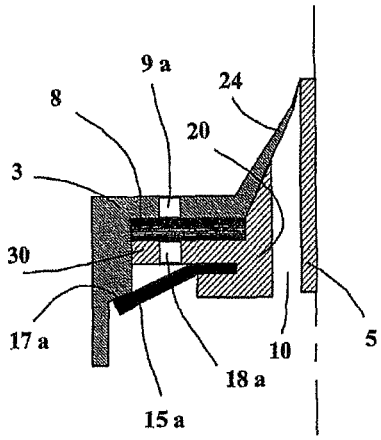
FIG. 8*c* is a view similar to FIGS. 8*a* and 8*b* of another variant in which the nozzle acts as the valve.
Figure 8B:
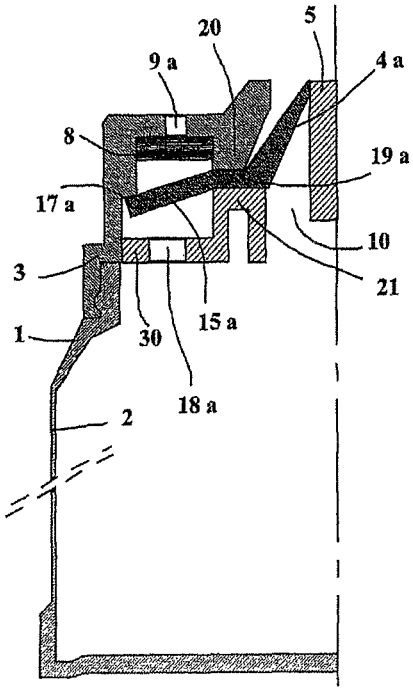
FIG. 8*b* is a view similar to FIG. 8*a* of a variant in which the two valves form a single piece.

FIG. 8*b* is a variant of FIG. 8*a* in which the valve 4*a* and the valve 15*a*, whose respective functions are to let product out and air in, as explained above, form a single component, being connected by their common portion 19*a* held between the portions 20 and 21. A sideways extension 30 of the portion 21 of the valve seat 5 allows the latter to be attached to the nozzle 3, and this extension 30 contains a passage 13*a* through which the air, which has passed through the passage 9*a* and the filter 8, can enter the interior of the container 1, when the valve 15*a* is not on its seat 17*a*.

In FIGS. 8*a* and 8*b*, the product is expelled by action on the flexible portion 2 of the container 1. Expulsion could equally well be brought about by acting on a flexible portion (not shown) of the nozzle 3, as in the example shown in FIG. 2, which can also be equipped with an additional valve in the air renewal and filtration assembly arranged in the base 6 of the container 1 or in the nozzle 3, as described above.

FIG. 8*a* can also include a dip tube 29 attached to a vertical or axial extension 28 of the valve seat 5. This dip tube 29, if fitted, allows the product to come as far as the outlet passage 10 and enables the whole device to be used the right way up. This construction can be applied to all the other variants described above, which can therefore be used in either position, that is to say the right way up, with the nozzle 3 at the top (see FIGS. 1, 2 and 3), or upside down, with the nozzle 3 at the bottom (see FIGS. 6 and 7). This makes it easier to use the device upside down for an opthalmological application and the right way up for nasal use.

FIG. 8*c* shows a combination of the means of FIGS. 5*b* and 8*a*, in which the air filtration and renewal assembly made up of the passage 9*a* and the filter 8 is positioned in the nozzle 3, and the elastic portion 24 of the nozzle that rests on the seat 5 replaces the valve 4. In this variant the filter 8 may be overmoulded onto the nozzle 3, or ultrasound-welded to the extension 30 of the seat 5, or assembled hermetically by any other means to one or other of these components. This figure shows the additional valve 15*a* whose flange is gripped in the portion 20 of the seat 5, and which presses, when at rest, against the seat 17*a* situated on the nozzle 3. During the phase in which external renewal air is admitted, its edge lifts off the seat 17*a* and the air passes into the container through the passage 9*a*, then through the filter 8, and finally through the passage 18*a* formed in the extension 30 of the seat 5. As in FIG. 8*a*, this extension 30 enables the seat 5 and the nozzle 3 to be joined together. This valve 15*a* is not compulsory and the system can function without it.

Figure 9:
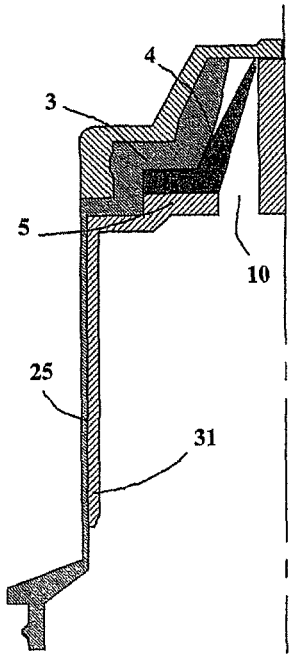
FIG. 9 is a view in axial half-cross section of a nozzle similar to that of the device depicted in FIG. 2, showing an elastic component acting as a return spring for the flexible portion of the nozzle.

FIG. 9 shows the nozzle 3 inside which an elastic component 31 boosts the elastic return of the flexible portion 25 in such a way as to create a more pronounced pressure drop inside the container 1, and therefore to facilitate the admission of renewal air by suction. This elastic component 31, shown inside the nozzle 3, is a continuation of the seat 5, but could be of any other shape and located anywhere about the device, provided it ensures a more effective return of the flexible portion of the container and/or of the nozzle to its initial position.

Figure 10:
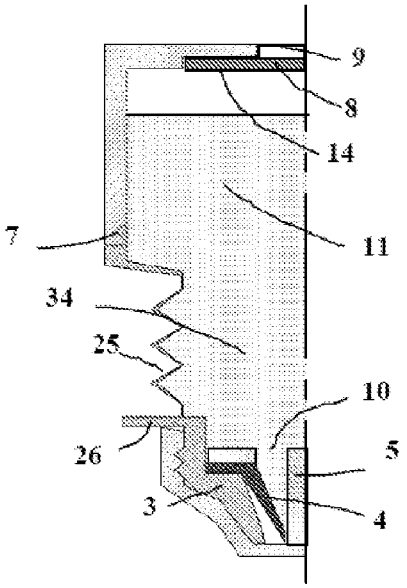
FIG. 10 is a view similar to FIG. 2 in which the flexible portion of the nozzle is concertina-shaped.

FIG. 10 shows a variant of the shape of the flexible portion 25 of the nozzle 3. This flexible portion 25 is not here squeeze sideways, but rather axially or vertically, by pressure on the collar 26; and since the concertina part of this flexible portion 25 makes contact, when compressed, with the rigid portion 7 of the container 1, it limits its range of movement, thus creating a dose-defining chamber 34, and allows the product to be dispensed in defined doses, allowing it to recover its initial shape by creating a pressure drop which will draw in renewal air through the filter 8. If this pressure drop is not great enough, it is possible to provide an additional elastic component to bring about a more effective return of the flexible portion 25. This additional part may be of any appropriate type and shape. Another possibility is an extension in the form of downward fringes (not shown) of the collar 26, which would itself act as a spring by pushing on a rigid portion of the container or of the actual nozzle 3.

Figure 11:
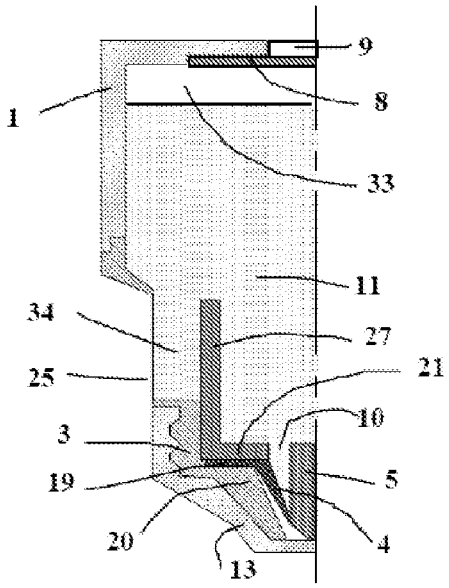
FIG. 11 is a view similar to FIG. 2 showing a component for limiting the deformation of the flexible portion of the nozzle.

FIG. 11 shows the container equipped with its nozzle 3, the flexible portion 25 of which has its range of sideways movement, when pushed, limited by an extension 27 of the annular portion 21 of the valve seat 5. In this way a dose-defining chamber 34 is demarcated between the flexible portion 25 and the extension 27. This limitation on the range of movement makes it possible to produce a more or less reproducible deformation of the flexible portion 25 and to dispense more or less identical portions of product when the dose-defining chamber 34 is compressed by squeezing the flexible part 25.

It should however be observed that the deformation of the flexible portion as shown in either FIG. 10 or 11 displaces a predetermined volume of product 11 and that this displacement produces an equivalent decrease in the volume of the air 33. This decrease in the volume of the air 33 causes the internal pressure of the container to rise and results in the expulsion of a portion of liquid from the container.

It should be observed that the residual volume of air 33 increases each time a portion of product 11 is expelled, and that the pressure increase caused by the displacement of a predetermined volume of product 11 declines as the device is used. This means that the expulsion of product 11 from the container is not effected by a constant force and dosage precision can consequently be impaired.

Figure 12:
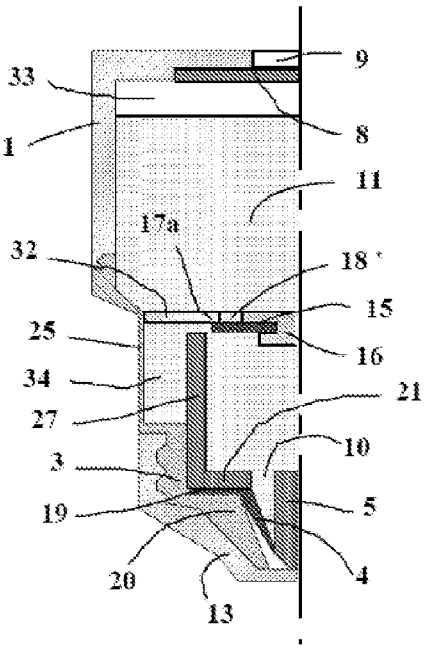
FIG. 12 is a view similar to FIG. 11 in which an additional valve and a seat for said valve are situated in the nozzle.

To overcome this problem it may be advantageous to site the additional valve 15 not in the immediate vicinity of the air renewal assembly but in the nozzle as shown in FIG. 12. Located here, the valve 15 will prevent the transmission to the air 33 of the pressure exerted on the liquid 11 by the deforming of the flexible portion 25, thus protecting its primary function which is to prevent air escaping when the flexible portion is squeezed, but will at the same time permit very precise doses to be defined because the expelled volume of liquid 11 will no longer depend on the pressure exerted by the air 33 held in the container.

Figure 13:
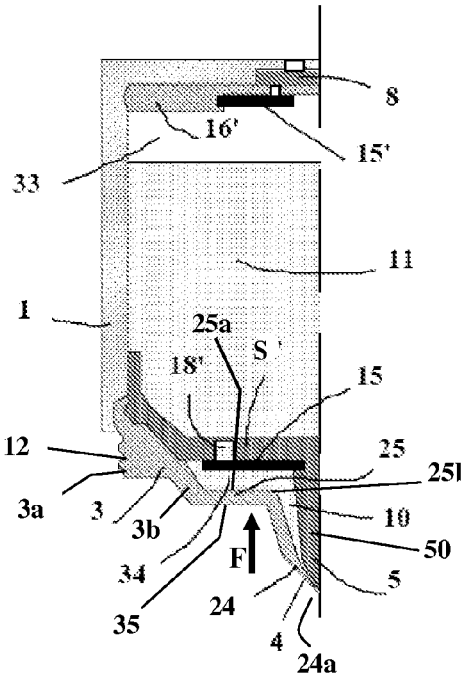
FIG. 13 is a view in axial half-cross section in which the flexible portion is situated in the nozzle which acts as a valve, the deformation of said flexible portion is limited, an additional valve and its associated seat are situated in the nozzle, and in which a third valve is depicted.

If it is necessary to prevent all contact between the product held in the container and the filter or if the environment outside the device such as a pressure decrease or a temperature rise could lead to liquid escaping from the container through the filter, it may be helpful to provide a third valve 15', as shown in FIG. 13, in the immediate vicinity of the filter. This third valve is not needed for the device to work well and is purely to maintain the leaktightness of the device when it is not being used.

Referring to FIG. 13, the stationary portion **3*a* of the nozzle 3 may be connected to the flexible portion 25 by a flexible hinge 3*b* that is part of the nozzle 3. Such flexible hinge 3*b* extends at the opposite of the free end 24*a*. An actuating portion 35 is advantageously defined in the flexible portion 25 to form a push button. Axial displacement of the actuating portion 35 enables to obtain an engagement position against the seat 5, especially against the annular portion 21 provided with the valve 15. Product in the dose-defining chamber 34** is entirely removed in such engagement position.

It is understood that, when the user pushes the actuating portion 35, the flowable product (liquid or low viscosity product or similar substance) present in the dose-defining chamber 34 is compressed. The displaceable inner surface **25*a* of the nozzle 3, initially in contact with the product in the rest position of the actuating portion 35, is moved to exactly fit with the seat 5. Because of such movement toward the bottom (upward movement when considering the FIG. 13), the movable part of the one way valve 15 is urged against the annular extension 21 to hence very effectively close the inlet passage 18' that communicates with the inside of the container 1. This enables the product to emerge from the free end 24*a* by deformation of the flexible portion 24 (causing opening the first valve 4) under the thrust of the pressurized product enclosed in the chamber 34**.

It should be observed that if the device comprises a separate base 6 containing the air renewal and filtration assembly, as shown in FIGS. 1, 3, 6 and 7, the container can advantageously be filled through the open end opposite the nozzle 3 in the upside-down position, before the rigid base 6 is put on.

If the air filtration and renewal device is located in the nozzle 3 and the latter has a flexible portion 25, the container 1 may either be moulded in synthetic material or produced from a material such as glass or metal.

Other embodiments of the container 1, of the base 6, of the nozzle 3, of the respective valves or of the component acting as a spring are possible without departing from the context of the invention. For example, it is possible to make a nozzle capable of dispensing precisely quantified drops, or a spray nozzle or any other dispensing nozzle designed for any application at all, provided this nozzle is accompanied by a valve which will allow only expulsion of the product.

Referring to FIG. 13 and FIG. **14*a*, it is understood that the dose-defining chamber 34 is used to defined the volume of the dose expelled through the free end 24*a* of the nozzle 3. Such dose is expelled when the actuating portion 35 is pushed by the user to deform the flexible portion 25 and engage the actuating portion 35 against an abutment surface 37 of the rigid stopper element S. For instance, the rigid stopper element S is a rigid single piece used to define the seat 5 or may comprises the radial annular extension 21 of the seat 5, the axial rod 50 of the seat 5, and optionally a stationary part of the valve 15 secured to the annular extension 21. The dose-defining chamber 34 thus extends between the abutment surface 37 of the rigid stopper element S and the displaceable inner surface 25*a* of the nozzle 3, which follows movement of the actuating portion 35**.

In a device such as shown in FIGS. 13, **14*a*-14*b*, the flexible hinge 3*b* is adjacent to the annular portion 21 and shifted radially toward the central axis with respect to a peripheral side wall of the stationary part 3*a* of the nozzle 3. With such configuration, the outer contact surface of the actuating portion 35 may extend close to the rod 50. This outer contact surface extends in continuation of a peripheral front surface of the stationary part 3***a* in the engagement position, as apparent in FIG. 14*b*. In other words, a flat angle or continuity is obtained between these surfaces in the engagement position. More generally, it is understood that the annular portion 21 of the rigid stopper element S and the flexible portion 25 of the nozzle 3 are preferably connected to form an angle inferior to 90° according to any axial section (or at least one axial section). With such angle (measured in the rest position of the actuation portion 35), the dose-defining chamber 34 may have a trapezoidal design in any axial section, being understood that the abutment surface 37 defines the larger side and the shorter side of the trapezoidal shape is essentially defined by the actuating portion 35.

Figure 14A:
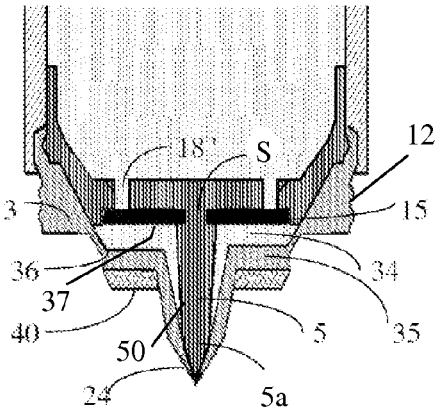
FIGS. 14*a* and 14*b* are respective schematic axial sectional views of a device completely similar to the device of FIG. 13, showing axial movement of an annular actuating portion having increased thickness to allow product to be expelled from a dose-defining chamber.
Figure 14B:
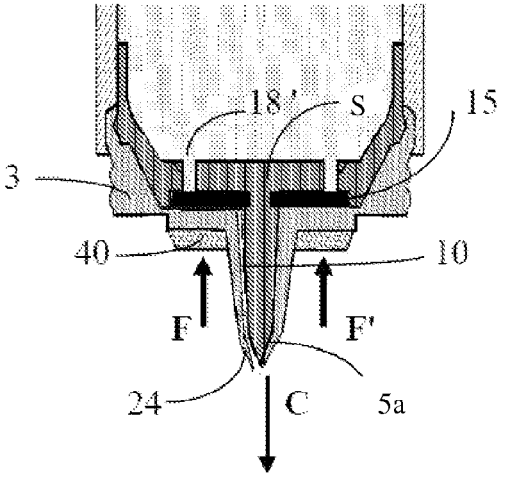

The chamber 34 shown in FIGS. 14*a*-14*b* extends annularly around the rod 50 of the seat. Axial displacement of the flexible portion 15 is here obtained by pushing the actuating portion 35 according to the direction of the arrows F and F'. The valve 15 may be annular, preferably circular, and extends between the annular portion 21 of the stopper element S and the actuating portion 35 that is here annular and has a greater thickness as compared to the other parts of the flexible portion 25. These other arts comprise an annular thin resilient connection 36 that is configured to allow return of the actuating portion 35 to its rest position. The thin resilient connection 36 is here adjacent to the junction between the nozzle 3 and the container 1.

To obtain the flexibility at the outer side of the chamber 34, a flexible hinge 3*b* or similar resilient connecting portion is provided, which extends adjacent and preferably around an outer perimeter of the actuating portion 35. Preferably, at least one of the actuating portion 35 and the stationary portion 3 have a greater thickness than such resilient connecting portion. The actuating portion 35, which is relatively thick and non-deformable, is articulated on one or more resilient and relatively thin connecting portions.

In the embodiments of FIGS. 13, 14*a*-14*b* and 15*a*-15*b*, it can be seen that a protruding of sharp edge 25*b* is defined in a position at the end of the inner surface 25*a* proximal relative to the rod 50 of the rigid stopper element S. Such edge allows to define a L-shape of the flexible portion 25 in any axial section, at least when the actuating portion 35 is in the engagement position. Such L-shape is advantageous to fit with the corresponding L-shape of the abutment surface 37.

It is also understood that the internal shape of the thick actuating portion 35 perfectly fits the geometry of the opposite side of the dose-defining chamber 34 when the actuating portion 35 is pushed and configured in the engagement position.

More generally, it is understood that the relatively thick actuating portion 35 can be pushed to fully compress the product in the chamber 34 and then returns to its initial rest position under the effect of one or more thin and elastic portions when it is released.

In the embodiments of FIGS. 13 and 14*a*-14*b*, the pushing is preferably exerted in two contact areas of the annular actuating portion, as illustrated by the arrows F and F'. The compression of the product can be symmetric around the rod 50 because of the guiding effect of such rod 50. A more rigid material may be used in an outer layer 40 of the actuating portion 35. Such material may be fixed in a conventional manner, for instance by overmolding operation, to the plastic material used to define the tapered shape of the nozzle 3.

Figure 15A:
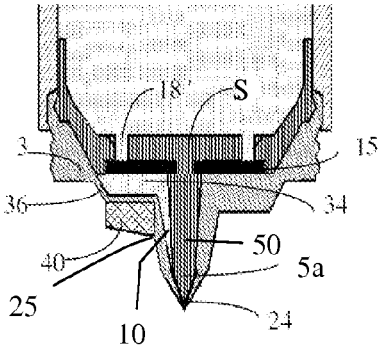
FIGS. 15*a* and 15*b* are views similar to FIGS. 14*a*-14*b* of a device provided with an actuating portion configured in a restricted angular sector and adapted to be displaced axially.
Figure 15B:
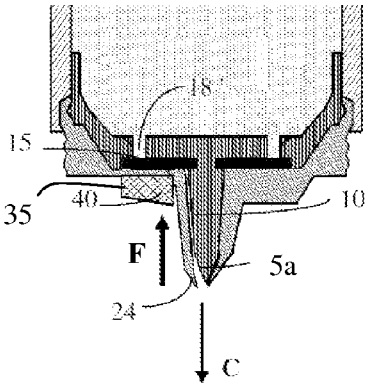

Referring to FIGS. 15*a*-15*b*, a device having the same container 1 and a variant of nozzle 3 is shown. The dose-defining chamber 34 is not annular and is only located in a restricted angular sector of the nozzle 3, namely in a part of the circumference. Two side faces 38, 38' are hermetically connected to the rod 50 and extend radially outwards from the rod 50. The side faces 38, 38' may be part of a rigid wall and the flexible portion 25 extends between these side faces 38, 38'. The non-annular, thin resilient connection 36 is used as hinge for pivotally biasing the actuating portion 35 toward the rest position (as shown in FIG. 15*a*). The outer layer 40 is preferably considerably more rigid than the inner layer adjacent the thin parts 36, 36', in order to make the actuating portion 35 incompressible.

The thin resilient connection 36 may surround the flexible portion 25 of the nozzle 3. The actuating portion 35, optionally provided with an outer layer 40 of more rigid material, may be pushed axially (according to the direction of arrow F) as in the devices of FIGS. 13 and 14*a*-14*b*. A local stretching of the flexible portion 25 is caused by movement of the actuating portion 35 toward the annular portion 21 of the rigid stopper element S. Such stretching occurs between the side faces 38, 38'.

Compression of the product is obtained, so that a flexible portion 24 of the valve 4 is deformed between the side faces 38, 38' and the product passes out at the free end 24*a*, along the end part 5*a* of the rod 50. As indicated by arrow C, the compressed product is expelled through passageway 10 that is also compressed when the engagement position is obtained.

As apparent in FIG. 15*b*, the product in the passageway 10 is also compressed because the displaceable inner surface 25*a* of the nozzle 3 is displaced radially inwardly when the actuating portion 35 is pushed axially toward the annular portion 21 of the rigid stopper element S. Such engagement position of the actuating portion 35 is thus suitable to cover the abutment surface 37 entirely, whereby the dose of product dispensed when moving the actuating portion to the engagement position is a precise dose that corresponds to the determined volume of the dose-defining chamber 34.

Figure 16:
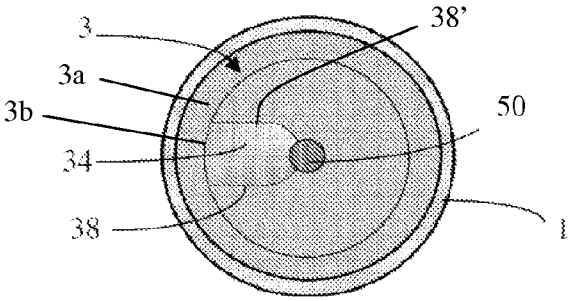
FIG. 16 is a cross section view of the device shown in FIGS. 15*a*-15*b*, showing the dose-defining chamber.

Referring to FIG. 16, the width of the chamber 34, defined between the side faces 38, 38' may be inferior to a third of the largest size of the nozzle 3. With such arrangement, the actuating portion 35 is easily identified by the user and is well adapted for pushing by a single finger. Here, the contact area is defined by the outer layer 40. Such outer layer 40 may be made from a gripping material distinct from the material used to define the flexible portions of the nozzle 3.

It should be noted that during its axial movement (see arrows F and F' in FIGS. 13, 14*b* and 15*b*) relative to the annular extension 21 of the rigid stopper element S, the actuating portion 25 is guided by guiding means. Such guiding means are defined by the axial rod 50 of the seat 5 when the actuating portion 35 is annular or by the side faces 38, 38' when the actuating portion 35 is configured relative to the rod 50 as a non-coaxial push button.

Now referring to FIGS. 17*a*-17*b* and 18*a*-18*b*, a different configuration of the dose-defining chamber 34 is shown because the chamber is at an axial distance from the annular portion 21 of the rigid stopper element. In contrast in FIGS. 13 to 16, the chamber 34 is adjacent to the valve 15 and the annular portion 21.

The chamber 34 may be as narrow as in the device of FIGS. 15*a*-15*b* and 16. The side faces 38, 38' here extend radially outwards from the rod 50 to thin elastic parts 36, 36' defined around the actuating portion 35. The chamber 34 extends in a limited angular sector with respect to the central rod 5, between the side faces 38 and 38'. The actuating portion 35 is made integral with the flexible portion 25 of the nozzle 3 and is here made using the same elastic material. A local increase in thickness is provided at the actuating portion 35, allowing a hinge effect at the two adjacent thin elastic parts 36, 36'. This allows the total thickness to be increased in this central part of the flexible portion 25, thus preventing local deformation of the outer contact surface of the actuating portion 35.

The two thin elastic parts 36, 36' are provided at outer end of the respective side faces 38, 38' that cannot be deformed. Such faces 38, 38' thus guide efficiently the actuating portion 35 to obtain the engagement position, after pushing it toward the central axis as shown by arrow A. Advantageously, the chamber 34 is entirely emptied once the inner surface 25 covers the abutment surface 37 that is here only defined by the rod 50 of the rigid stopper element S.

Figure 17A:
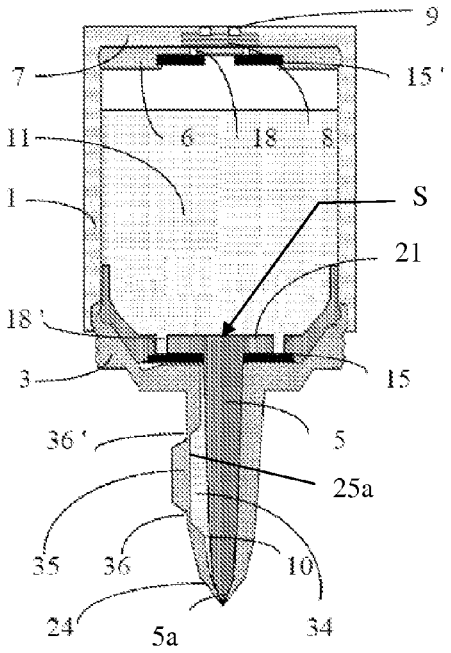
FIGS. 17*a* and 17*b* are respective schematic axial sectional views of a device according to the invention, showing a container made of two rigid parts fitted together hermetically and showing radial movement of an actuating portion configured as a radial protrusion in the nozzle.
Figure 17B:
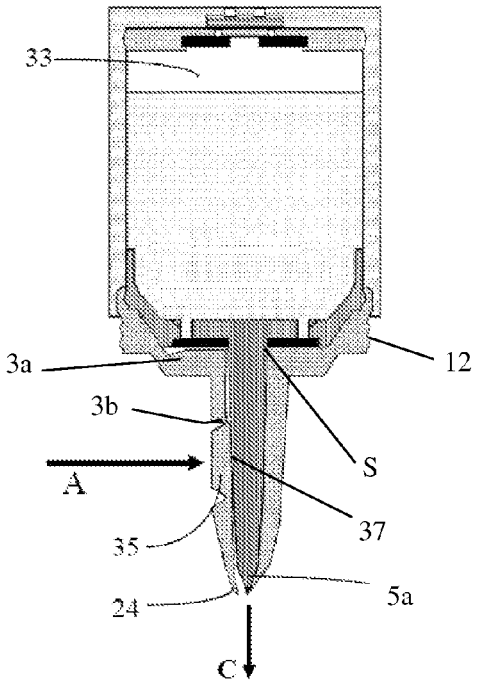

The outer contact face of the actuating portion 35 may substantially extend in continuation of the side wall of the nozzle 3 in the engagement position, as shown in FIG. 17*b*. The volume of the actuating portion 35 may be considered as at least equal to the determined volume of product that is contained in the chamber 34.

The one way valve 15 prevents any return of product to the container when the actuating portion 35 is pushed and the product compressed. The inlet passage 18' is open when the inner surface 25*a* of the flexible portion 25 is displaced away from the abutment surface 37 for a return of the chamber 34 to its original shape. After the chamber 34 is filled and the rest position of the actuating portion 35 is obtained, the valve 15 remains in a closed state.

Figure 18A:
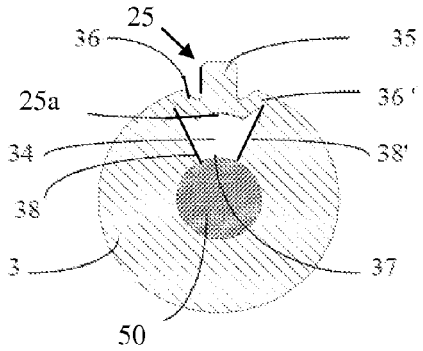
FIGS. 18*a* and 18*b* are respective cross section views of the device shown in FIGS. 17*a*-17*b*, respectively showing the actuating portion in a rest position and in an engagement position.
Figure 18B:
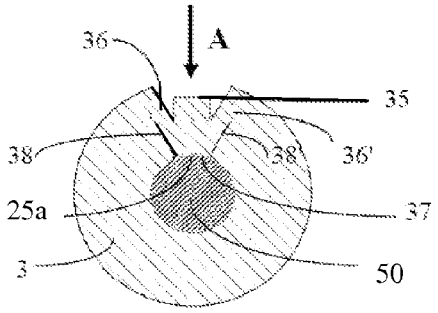

Referring to FIGS. 18*a*-18*b*, the chamber 34 is only delimited in cross section by:

the abutment surface 37 at the rod 50;

the two side faces 38, 38'; and the inner surface 25*a* and adjacent flexible hinges defines by the thin parts 36, 36'.

It can be seen that the inner surface 25*a* has a concave shape that perfectly fits with the convex shape of the abutment surface 37 (same geometry to obtain full removal of product). FIG. 18*b* shows that no product remains along the rod 50, so that the chamber 34 is fully emptied. Indeed, the side faces 38, 38' are in contact with the flexible thin parts 36, 36' that have been stretched and deformed under the pushing action (arrow A).

More generally, it is understood that the flexible portion 25 has an outer perimeter that fits with outer perimeter of the does defining chamber 34. For instance, the actuating portion 35 has a circular shape when the chamber 34 is circular and the slight difference with respect to the diameter is suppressed by deformation of the at least one resilient connecting portion (36, 36') defined around the actuating portion 35. Of course, the geometry of the inner surface 25*a* and the abutment surface 37 are complementary in such case.

Figure 19A:
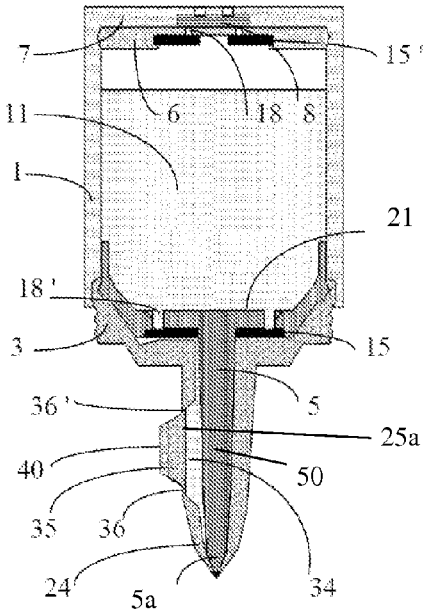
FIGS. 19*a* and 19*b* are respective schematic axial sectional views of a device completely similar to the device of FIGS. 17*a*-17*b*, showing radial movement of an actuating portion having increased thickness to allow product to be expelled from a dose-defining chamber.
Figure 19B:
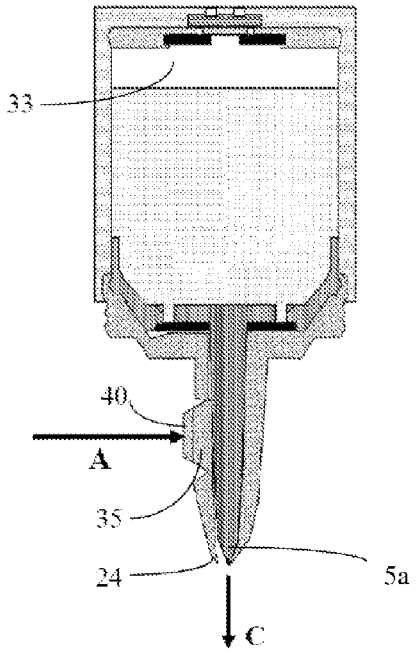

FIGS. 19*a*-19*b* show a product-dispensing assembly functionally and structurally similar to the preceding embodiment, but a second layer, here an outer layer 40, is used in the actuating portion 35 to increase the global rigidity in this central part of the flexible portion 25. The outer layer 40 is made from a different material that does not deform during the pushing action. Such increase in thickness thus locally decreases the flexibility. Accordingly, the actuating portion 35 can be considered as rigid because, practically, only the thin connecting portion at 36, 36' will deform when the user pushes the actuating portion 35. Here, the outer contact surface is entirely defined by the outer layer 40.

Figure 20A:
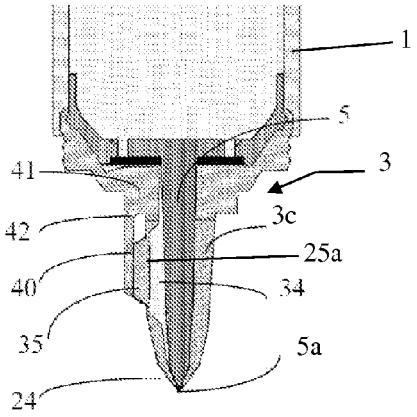
FIGS. 20*a* and 20*b* are respective schematic axial sectional views of a device provided with an actuating portion connected to rigid stationary portion of the nozzle, showing radial movement of the actuating portion.
Figure 20B:
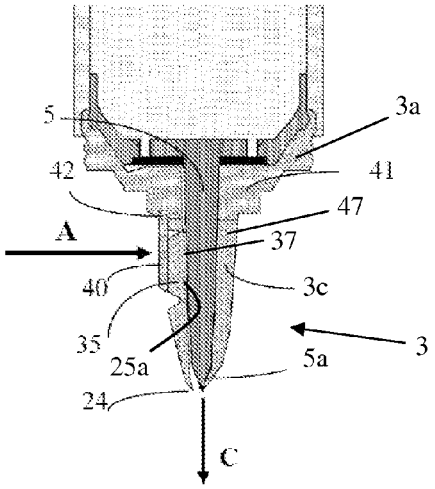

FIGS. 20*a*-20*b* show a variant, in which the second layer is connected to the stationary portion 3*a* of the nozzle 3 by an auxiliary hinge 42 (corresponding to a flexible thin part) and is configured to pull the first layer of the actuating portion 35 outwards when the actuating portion 35 is released. Here, the stationary portion 3*a* is made of a material that is more rigid the plastic material used to define the flexible portions of the nozzle 3. The second layer here defines the outer layer 40 of the actuating portion 35. The stationary part 3*a* may comprise a first rigid piece 41 made of the rigid material (preferably plastic material) and a non-annular portion 47 that extends along the rod 50 and to which the flexible portion 35 is laterally attached. The portions 35 and 47 may be made of the same plastic material.

The nozzle 3 here comprises an operating part 3*c* fixed, for instance by overmolding operation, to the first rigid piece 41. The chamber 34 is defined in an interior volume of the operating part 3*c*. The operating part 3 and the first rigid piece 41 extend annularly around the central axis of the nozzle 3. The first rigid piece 41 defines a connecting interface directly attached to the container 1. The first rigid piece 21 cannot be compressed. The operating part 3*c* comprises the flexible portions of the nozzle 3 and extends axially, between the attachment area to the first rigid piece 41 and the free end of the nozzle 3.

The auxiliary hinge 42 is here defined in the first rigid piece 41 and the outer layer 40 is part of the first rigid piece 41. It is understood that the inner layer of the actuating portion 35 is secured to the outer layer 40 and follows movement of the outer layer 40.

As shown in FIG. 20*b*, the displaceable inner surface 25*a* is in contact with and entirely covers the abutment surface 37 in said engagement position of the actuating portion 35, so that the dose of product dispensed when moving the actuating portion 35 from the rest position to the engagement position corresponds to the determined volume of the dose-defining chamber 34. The auxiliary hinge 42 and the thin connecting portions at 36, 36' are acting together when a push action (see arrow A) is exerted radially inward on the outer contact surface of the actuating portion 35.

As the bonding at the auxiliary hinge 42 is typically stronger, it acts as a return spring, causing a pulling action of the outer layer 40 to drive the inner layer away from the abutment surface 37. The return to the original rest position is thus efficiently obtained. With such configuration, the determined volume remains constant after repeated use because of the pulling action of the outer layer 40 on the first layer (outward movement) when the actuating portion 35 is released.

More generally, the resilience and the spring-like effect at the junction between the flexible portion 25 and the stationary portion 3*a* is advantageous for contacting a rigid abutment surface 37 at least as large as the outer contact surface of the actuating portion 35. Moreover, the size of the dose-defining chamber 34 remains the same. The dose-defining chamber 34 thus always defines a same determined volume in the rest position of the actuating portion 35.

Use of an inner surface 25*a* that perfectly fits with the geometry of the abutment surface 37 is advantageous to fully expel the product contained in the dose-defining chamber 34. The product-dispensing assembly allows delivery of precise doses. When pushed to the engagement position as shown in FIGS. 14*b*, 15*b*, 17*b*, 18*b*, 19*b* and 20*b*, the actuating portion 35 and the corresponding flexible portion 25 extends along the abutment surface 37. The actuating portion 35 is preferably sufficiently thick and/or sufficiently close to the flexible hinge 3*b*, so that the shape of the actuating portion 25 is the same in the engagement position and in the rest position. Such configuration is advantageous to prevent incomplete compression of the product contained in the dose-defining chamber 34.

The device can be compact and is well adapted to supply same precise doses of liquid or low viscosity product. The device is suitable particularly in pharmaceutical, cosmetic and ophthalmological applications.

What is claimed is:

1. A device for packaging and dispensing a flowable product, comprising:

a casing comprising a nozzle for dispensing the product and a container designed to contain the product to be packaged, the casing comprising a rigid bottom;

an air renewal and filtration assembly for air entering the container after a dose of product had been dispensed;

a filter element for filtering air entering the container;

an air inlet passage located in said rigid bottom, the rigid bottom comprising an interior surface facing the inside of the container and covered by said filter element;

wherein said nozzle extends around a central axis and comprises:

a tapered portion that defines a free end of the nozzle;

an actuating portion resiliently movable between an engagement position and a rest position;

an outer contact surface defined by the actuating portion, and when pressure is applied to the actuating portion at the outer contact surface by a user, the actuating portion is capable of expelling product;

a displaceable inner surface that follows movement of the actuating portion;

a first valve to allow the product to pass out through the free end when pressure is applied to said actuating portion without allowing external air to enter said casing through the free end when said actuating portion is released;

wherein said device further comprises:

a second valve arranged in such a way as to isolate a dose-defining chamber from the air contained in the container, the dose-defining chamber having a determined volume in the rest position of the actuating portion;

a rigid stopper element provided with an abutment surface that defines with said displaceable inner surface the dose-defining chamber, said engagement position being obtained by engaging the actuating portion of the nozzle against the abutment surface of the rigid stopper element;

wherein the displaceable inner surface is in contact with and entirely covers the abutment surface in said engagement position of the actuating portion, so that the dose of product dispensed when moving the actuating portion from the rest position to the engagement position corresponds to the determined volume of the dose-defining chamber, wherein the actuating portion is configured to be pushed as a push button according to a direction perpendicular to the central axis, and wherein the dose-defining chamber extends between two side faces that are hermetically connected, radially, to the rigid stopper element, said two side faces defining an angle inferior or equal to 120° at the connection to the rigid stopper element.

2. The device as claimed in claim 1, wherein the nozzle comprises a stationary portion, the actuating portion being connected to the stationary portion by a resilient connecting portion, at least one of the actuating portion and the stationary portion having a greater thickness than the resilient connecting portion.

3. The device as claimed in claim 1, wherein the actuating portion is adjacent to at least one flexible hinge that is part of the nozzle.

4. The device as claimed in claim 3, comprising guiding means configured to guide movement of the actuating portion toward the rigid stopper element and prevent deviation with respect to a predetermined pushing direction for pushing the actuating portion.

5. The device as claimed in claim 3, wherein the flexible hinge extends at the opposite of the free end of the nozzle and the actuating portion is configured to be pushed according to a direction parallel to the central axis.

6. The device as claimed in claim 1, wherein the actuating portion extends between the first valve and the second valve, said second valve being arranged in the internal volume of the casing and fixed to a rigid element that is spaced from said rigid bottom.

7. The device as claimed in claim 1, further comprising a third valve designed to prevent the escape of product and air when the device is not being used, said third valve being arranged between said filter element and the internal volume of the container to prevent any contact between the product and said filter element.

8. The device as claimed in claim 2, wherein the actuating portion and the resilient connecting portion are parts of a flexible portion of the nozzle distinct from the stationary portion that is rigid, and wherein the actuating portion comprises:

a first layer made of a first material and integral with the flexible portion of the nozzle; and a second layer made of a second material more rigid than the first material.

9. The device as claimed in claim 8, wherein said second layer is connected to the stationary portion by an auxiliary hinge and is configured to pull the first layer outwards when the actuating portion is released.

10. The device as claimed in claim 8, wherein said second layer defines the outer contact surface of the actuating portion.

11. The device as claimed in claim 2, wherein said container comprises a substantially rigid portion to which the stationary portion of the nozzle is directly fixed, the stationary portion comprising a rigid portion.

12. The device as claimed in claim 1, wherein said first valve is formed by at least a portion of the nozzle itself.

13. The device as claimed in claim 1, wherein the rigid bottom defines a base at the opposite end of the casing from the nozzle, the rigid bottom allowing the casing to be maintained according to a vertical position.

14. The device as claimed in claim 13, wherein the rigid bottom comprises:

a central portion surrounded by a continuous annular portion; and a central recess obtained by a reduction of thickness of the central portion as compared to the thickness of the annular portion.

15. The device as claimed in claim 14, wherein the filter element extends in the central recess.

16. The device as claimed in claim 1, further comprising a protective cap, and wherein said nozzle comprises an external thread so that said protective cap can be screwed directly on said nozzle, the protective cap covering the outer contact surface of the actuating portion.

17. A device for packaging and dispensing a flowable product, comprising:

a casing comprising a nozzle for dispensing the product and a container designed to contain the product to be packaged, the casing comprising a rigid bottom;

an air renewal and filtration assembly for air entering the container after a dose of product had been dispensed;

a filter element for filtering air entering the container;

an air inlet passage located in said rigid bottom, the rigid bottom comprising an interior surface facing the inside of the container and covered by said filter element;

wherein said nozzle extends around a central axis and comprises:

a tapered portion that defines a free end of the nozzle;

an actuating portion resiliently movable between an engagement position and a rest position;

an outer contact surface defined by the actuating portion, and when pressure is applied to the actuating portion at the outer contact surface by a user, the actuating portion is capable of expelling product;

a displaceable inner surface that follows movement of the actuating portion;

a first valve to allow the product to pass out through the free end when pressure is applied to said actuating portion without allowing external air to enter said casing through the free end when said actuating portion is released;

a stationary portion, the actuating portion being connected to the stationary portion by a resilient connecting portion, at least one of the actuating portion and the stationary portion having a greater thickness than the resilient connecting portion;

wherein said device further comprises:

a second valve arranged in such a way as to isolate a dose-defining chamber from the air contained in the container, the dose-defining chamber having a determined volume in the rest position of the actuating portion;

a rigid stopper element provided with an abutment surface that defines with said displaceable inner surface the dose-defining chamber, said engagement position being obtained by engaging the actuating portion of the nozzle against the abutment surface of the rigid stopper element;

wherein the displaceable inner surface is in contact with and entirely covers the abutment surface in said engagement position of the actuating portion, so that the dose of product dispensed when moving the actuating portion from the rest position to the engagement position corresponds to the determined volume of the dose-defining chamber, wherein the actuating portion and the resilient connecting portion are parts of a flexible portion of the nozzle distinct from the stationary portion that is rigid, and wherein the actuating portion comprises:

a first layer made of a first material and integral with the flexible portion of the nozzle;

a second layer made of a second material more rigid than the first material; and wherein said second layer is connected to the stationary portion by an auxiliary hinge and is configured to pull the first layer outwards when the actuating portion is released.

18. The device as claimed in claim 17, wherein the actuating portion is configured to be pushed according to a direction perpendicular to the central axis.

19. The device as claimed in claim 17, wherein the dose-defining chamber extends between two side faces that are hermetically connected, radially, to the rigid stopper element, said two side faces defining an angle inferior or equal to 120° at the connection to the rigid stopper element.

20. The device as claimed in claim 17, further comprising a protective cap, and wherein said nozzle comprises an external thread so that said protective cap can be screwed directly on said nozzle, the protective cap covering the outer contact surface of the actuating portion.

21. The device as claimed in claim 17, wherein said actuation portion is defined in a side wall of the nozzle and is arranged to be pushed radially toward the central axis, said nozzle being arranged around a central axial seat, the first valve allowing the product to be dispensed through a non-annular channel defined along said central axial seat.

* * * * *